US011624031B2

(12) United States Patent
Obaia

(10) Patent No.: US 11,624,031 B2
(45) Date of Patent: Apr. 11, 2023

(54) TILED SCREEN CLOTH

(71) Applicant: SYNCRUDE CANADA LTD. in trust for the owners of the Syncrude Project as such owners exist now and in the future, Calgary (CA)

(72) Inventor: Khaled Obaia, Edmonton (CA)

(73) Assignee: SYNCRUDE CANADA LTD., Calgary (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 17/182,444

(22) Filed: Feb. 23, 2021

(65) Prior Publication Data

US 2022/0267678 A1 Aug. 25, 2022

(51) Int. Cl.

| | |
|---|---|
| ***C10G 1/04*** | (2006.01) |
| ***B07B 1/40*** | (2006.01) |
| ***B07B 1/46*** | (2006.01) |

(52) U.S. Cl.

CPC ..... *C10G 1/045* (2013.01); *B07B 1/40* (2013.01); *B07B 1/4609* (2013.01); *C10G 1/047* (2013.01)

(58) Field of Classification Search

CPC ..... C10G 1/04–047; B07B 1/28; B07B 1/40; B07B 1/4609; B07B 1/4618

See application file for complete search history.

(56) References Cited

U.S. PATENT DOCUMENTS

| | | | | |
|---|---|---|---|---|
| 9,724,732 | B2 * | 8/2017 | Moon | B07B 1/4618 |
| 2013/0092608 | A1 * | 4/2013 | Tieu | B07B 1/4609 209/392 |
| 2016/0038976 | A1 * | 2/2016 | Moon | B07B 1/28 209/397 |
| 2017/0043376 | A1 * | 2/2017 | Tieu | B07B 1/4618 |

FOREIGN PATENT DOCUMENTS

| | | |
|---|---|---|
| CA | 2755026 | 4/2013 |
| CA | 2992665 | 1/2017 |
| DE | 3413613 C2 | 10/1985 |

* cited by examiner

*Primary Examiner* — Renee Robinson

(74) *Attorney, Agent, or Firm* — Bennett Jones LLP

(57) ABSTRACT

A screen cloth for use in a screening device for screening out oversize objects, including oil sand lumps and rocks, is disclosed comprising a supporting structure comprising two mutually opposing lateral attachment elements and a plurality of transverse stiffeners extending therebetween; and a plurality of screen segments, each screen segment having a plurality of openings, and each screen segment comprising a steel base and a plurality of anti-wear tiles attached thereon; whereby the plurality of screen segments are attached to the support structure to form a screening portion of the screen cloth.

21 Claims, 4 Drawing Sheets

TILED SCREEN CLOTH

FIELD OF THE INVENTION

The present invention relates generally to a tiled screen cloth particularly useful for vibrating screens for screening oversize objects in a material such as an oil sand slurry.

BACKGROUND OF THE INVENTION

Vibrating, rotating and/or stationary screens are used in the oil sand industry, in particular, in oil sand slurry preparation plants. Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase.

As-mined or pre-crushed oil sand is generally mixed with warm or hot water to yield an oil sand slurry. The slurry is then conditioned in a hydrotransport pipeline and subsequently introduced into a large, open-topped, conical-bottomed, cylindrical vessel commonly termed a primary separation vessel (PSV) where the more buoyant aerated bitumen rises to the surface and forms a bitumen froth layer.

It may be desirable to remove the larger aggregates present in oil sand slurry prior to pipelining in order to avoid blockage or damage of downstream equipment, e.g., pump component wear. Thus, vibrating, rotating and/or stationary screens may be used at various points during slurry preparation to reject larger lumps of oil sand, rocks and other aggregates, which are large enough to block or damage downstream equipment, prior to pipeline conditioning. Screens may also be used to further screen oil sand tailings slurry prior to treating/disposing same.

However, oil sand slurry is extremely heavy and abrasive due to the large amount of sand, gravel and crushed rock contained therein. Further, in particular with primary vibrating screens, these screens are generally vibrating with an acceleration of approximately 4-5 g, so that all oil sand slurried material passes over and through the screen cloths of the vibrating screen. This results in the rapid spalling and eventual wearing through of the screen cloths of the vibrating screen ("hole-throughs"), which can lead to production interruption and an unplanned maintenance event.

Currently, screen cloths comprising chromium white iron (CWI) longitudinal and transverse ligaments having two passes of plasma transferred arc welding tungsten overlays (9 mm in thickness) are the best available design for oil sands vibrating screens. However, the whole screen has a weak area in the transverse ligaments, which area wears first to expose the mild steel underneath to the erosive oil sand slurry. Because of this weakness, the screen cloths require repair in mid life, which limits the mission run of the whole plant.

Canadian Patent Application No. 2,992,665 discloses a screen segment useful in screening oil sands comprising a substantially screen-shaped base plate whereon a plurality of support plates having a plurality of plate-shaped anti-wear element thereon are joined to the base plate, e.g., by substance-to-substance bonding. However, such screens are very heavy and would weigh down a vibrating screening device.

Thus, it is desirable to have a screen cloth that can withstand the abrasiveness of oil sand slurry while being light enough to be used on a vibrating screening devise.

SUMMARY OF THE INVENTION

It was discovered that the currently used screen cloths for vibrating screening devices that are used to screen oil sand lumps, which are often frozen, rocks and the like from oil sand slurry were wearing through much quicker than desired due to the abrasive nature of the slurry. In particular, it was discovered that screen cloths of vibrating screening devices were suffering from localized wear phenomena resulting from the slurry flow distribution.

The current application is directed to screen cloths useful for screening an oil sand slurry having oversize reject material. Use of the present invention extends the running time of a vibrating screening device so that the operator does not have to shut down the screening device as frequently to replace the impact screen cloths. It is understood, however, that the screen cloths of the present invention can also be used with rotating and/or stationary screening devices.

Broadly stated, in one aspect of the present invention, a screen cloth for use in a screening device for screening out oversize objects, including oil sand lumps and rocks, is provided, comprising:

- a supporting structure comprising two mutually opposing lateral attachment elements and a plurality of transverse stiffeners extending therebetween; and
- a plurality of screen segments, each screen segment having a plurality of openings, and each screen segment comprising a steel base and a plurality of anti-wear tiles attached thereon;
- whereby the plurality of screen segments are attached to the support structure to form a screening portion of the screen cloth.

In one embodiment, the plurality of screen segments are first attached to one another prior to being attached to the support structure. In another embodiment, the anti-wear tiles are sintered tungsten carbide tiles. In another embodiment, the screen cloth further comprises at least two attachment segments having a plurality of anti-wear tiles attached thereon for attaching to the two lateral attachment elements, respectively.

In one embodiment, the plurality of anti-wear tiles are attached to the screen segments and the attachment segments by means of brazing.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the following figures. It is understood that the drawings provided herein are for illustration purposes only and are not necessarily drawn to scale.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a light weight screen cloth with improved wear properties for use in screening raw materials such as crushed oil sand, ores and the like, and, in particular, screening oil sand slurry using a vibrating screening device comprising the screen cloths.

Figure 1:
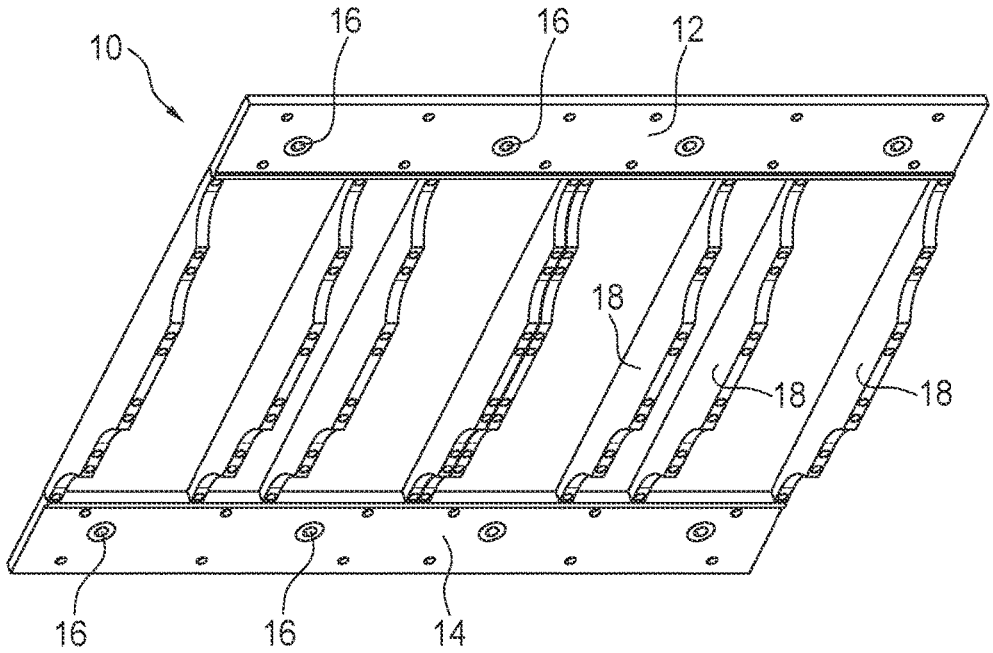
FIG. 1 is a bottom view of a supporting structure of a screen cloth of the present invention.

FIG. 1 illustrates a supporting structure of an embodiment of a screen cloth of the present invention. Supporting structure 10 comprises two mutually opposing lateral attachment elements, first lateral attachment element 12 and second lateral attachment element 14. Lateral attachment elements 12, 14 have at least one fastening hole 16 drilled therethrough for attaching the lateral attachment elements to, for example, a vibrating screening device's cross beams by means of bolts, screws and the like. In FIG. 1, each lateral attachment element has four fastening holes 16.

Extending between and attached at each end to the first and second lateral attachment elements 12, 14 are a plurality of transverse stiffeners 18. Generally, the transverse stiffeners 18 are attached to the lateral attachment elements 12, 14 by means of welding. Each of the lateral attachment elements and the transverse stiffeners are made of a mild steel, a corrosion resistant steel such as stainless steel, or other wear resistant steel. The supporting steel structure forms the base of the screen cloths of the present invention.

Figure 2A:
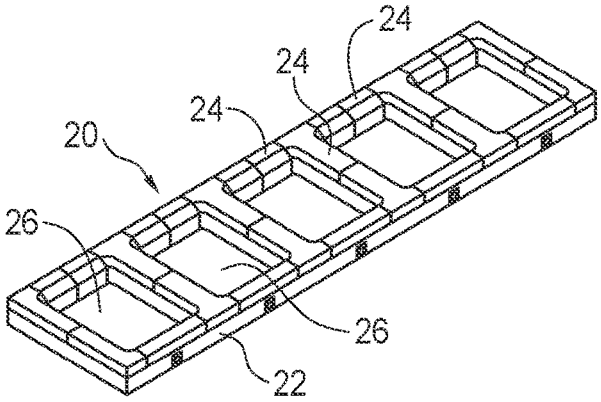
FIG. 2A is a perspective view of a screen segment having anti-wear tiles attached thereon for use in a screen cloth of the present invention.

FIG. 2A is a perspective view of a screen segment 20 of the present invention. Screen segment 20 is comprised of base plate 22, generally made of a mild steel, a corrosion resistant steel such as stainless steel, or other wear resistant steel, having a plurality of screen openings 26, made by plasma cut or machining, therethrough. The screen segment 20 shown in FIG. 2A comprises five such screen openings 26. Attached to the upper surface of base plate 22 are a plurality of anti-wear tiles 24 made from a hard metal such as cemented or sintered tungsten carbide, chrome carbide, titanium carbide or ceramic. In one embodiment, the anti-wear tiles 24 are attached to base plate 22 by brazing, usually accomplished by using a filler metal with a melting temperature above 450° C. (840° F.), mechanical fasteners or using an industrial adhesive (glue) such as epoxies. In one embodiment, the anti-wear tiles 24 are square or rectangular in shape and are comprised of about 89 to 91% tungsten carbide. In one embodiment, the anti-wear tiles 24 are about 6 to 12 mm in thickness, however, the anti-wear tiles can be greater than 12 mm in thickness. In one embodiment, the screen segment 20 is rectangular, 32 mm in thickness and about 175×659 mm in dimension.

Figure 2B:
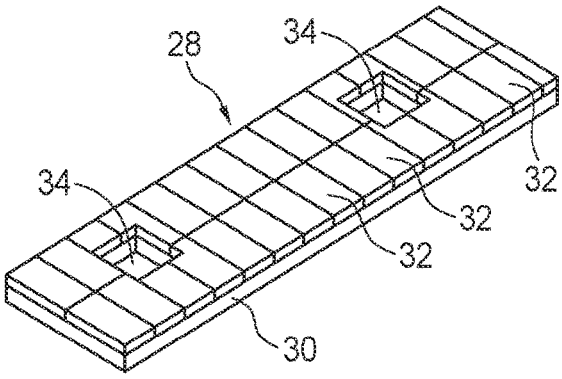
FIG. 2B is a perspective view of an attachment segment having anti-wear tiles attached thereon for use in a screen cloth of the present invention.

FIG. 2B is a perspective view of an attachment segment 28 of the present invention. Attachment segment is comprised of base plate 30, generally made of steel, having a plurality of attachment holes 34 therethrough. The attachment segment of FIG. 2B has two such attachment holes. The attachment holes 34 correspond to fastening holes 16 in supporting structure 10 of FIG. 1. Attached to the upper surface of base plate 30 are a plurality of anti-wear tiles 32 made from a hard metal such as sintered tungsten carbide. In one embodiment, the anti-wear tiles 32 are attached to base plate 30 by brazing. In one embodiment, the anti-wear tiles 32 are rectangular in shape and are comprised of about 89 to 91% tungsten carbide. In one embodiment, the anti-wear tiles 32 are about 6 to about 12 mm in thickness. It is understood that the anti-wear tiles can be greater than 12 mm in thickness. In one embodiment, the attachment segment 28 is rectangular, 32 mm in thickness and about 175×659 mm in dimension.

The attachment of anti-wear tiles 24 and 32 to smaller base plates 22 and 30, respectively, to form screen segments 20 and attachment segments 28, respectively, allows for better brazing quality as opposed to brazing anti-wear tiles to a larger base plate.

Figure 3:
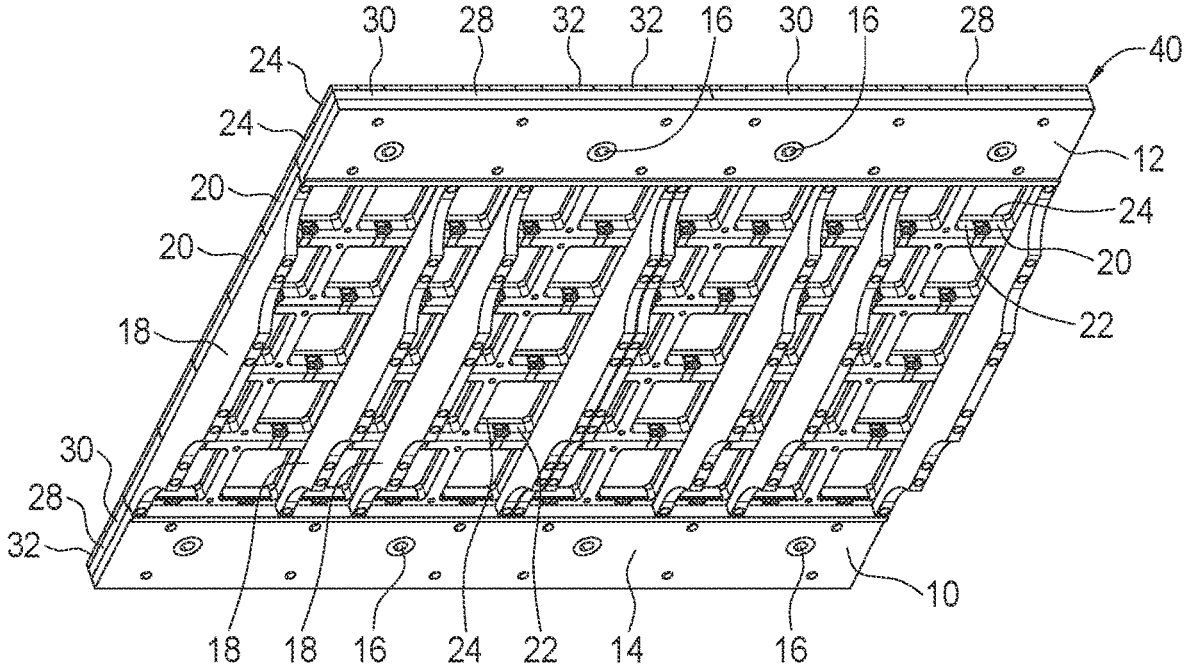
FIG. 3 is a perspective view of an embodiment of a screen cloth of the present invention, viewed from the bottom.
Figure 4:
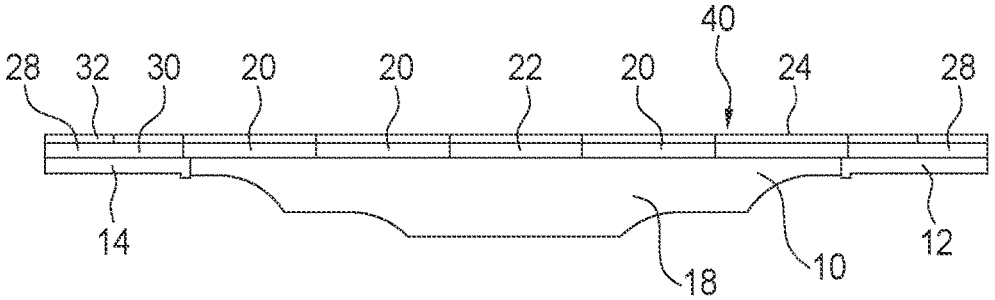
FIG. 4 is an end view of the screen cloth of FIG. 3.
Figure 5:
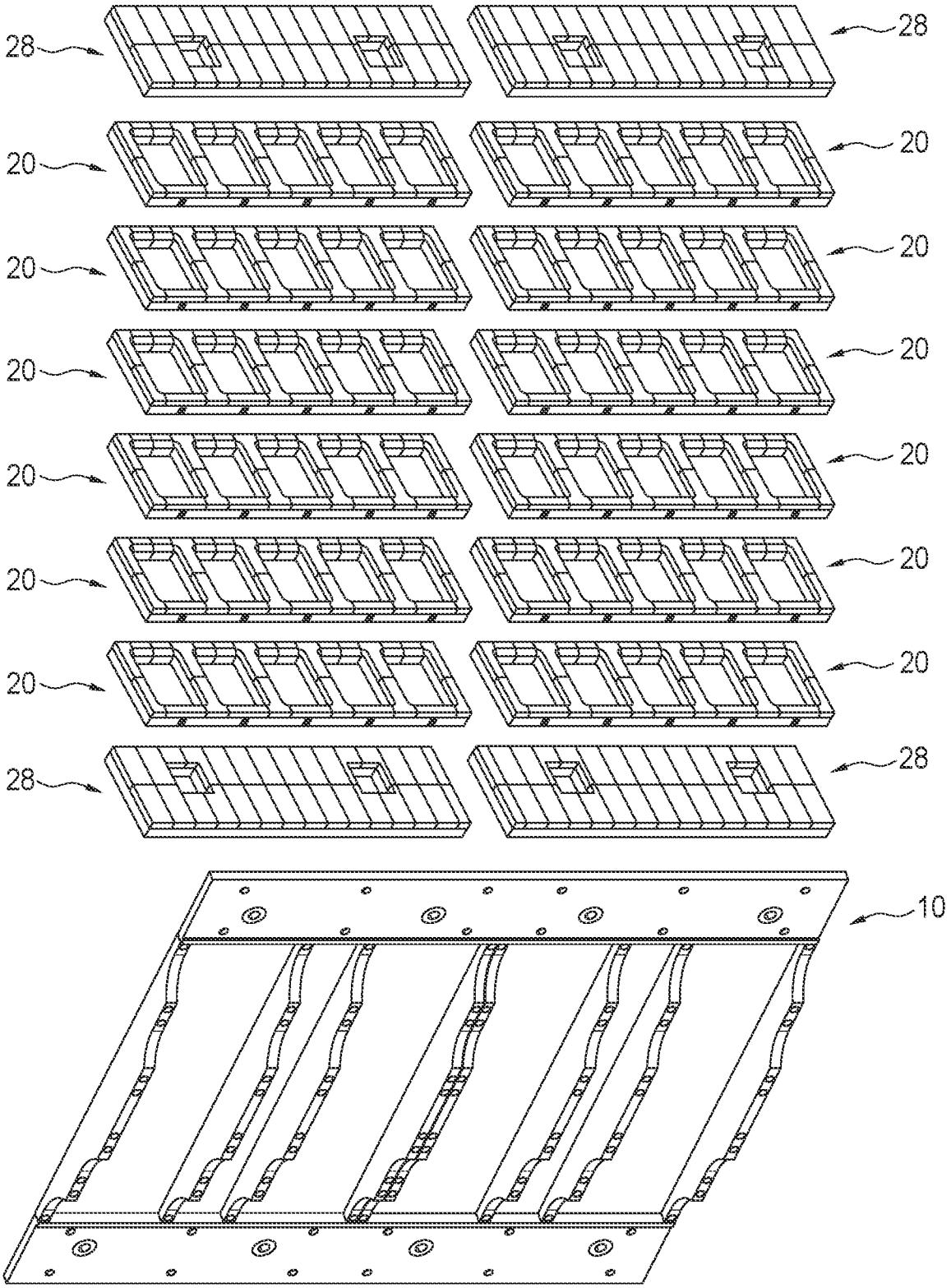
FIG. 5 is an illustration as to how screen and attachment segments are arranged on a supporting structure to form a screen cloth of the present invention.
Figure 6:
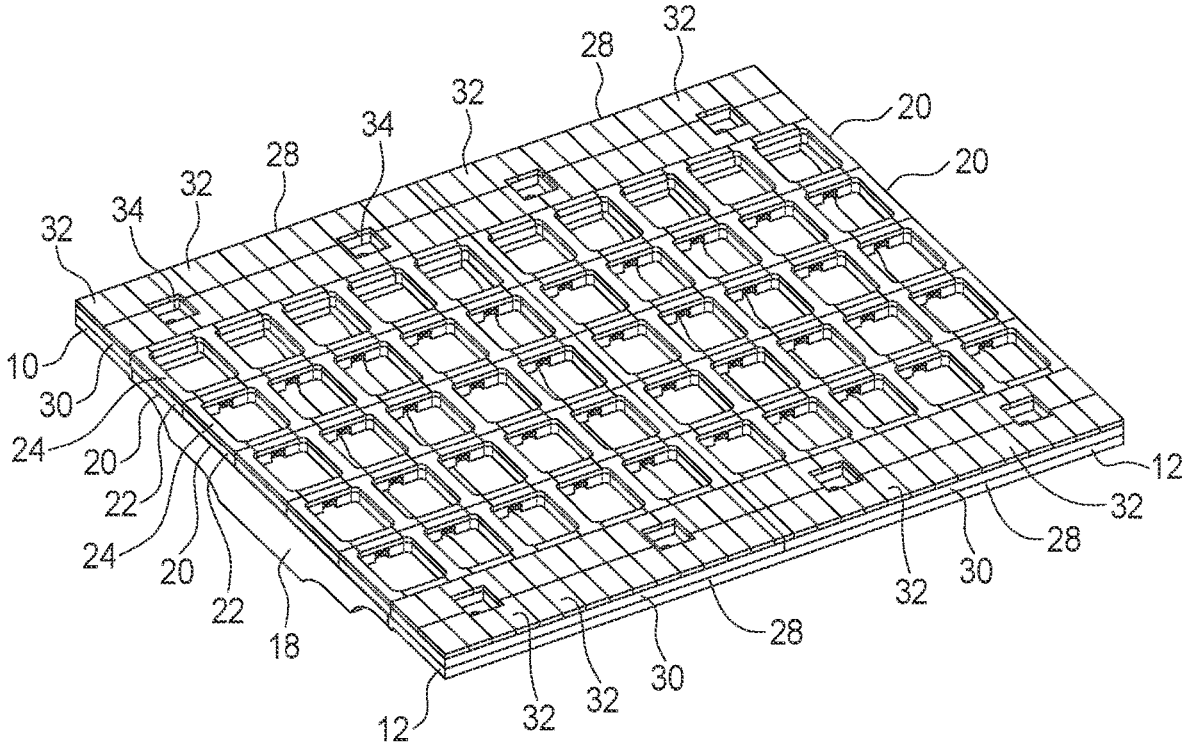
FIG. 6 is a perspective view of an embodiment of a screen cloth of the present invention, viewed from the top.

FIG. 3 is a perspective view of an embodiment of a screen cloth, screen cloth 40, of the present invention viewed from the bottom and FIG. 4 is an end view of screen cloth 40. In this embodiment, four attachment segments 28 and twelve screen segments 20 are bolted and welded together, as shown in FIG. 3, such that two pairs of attachment segments 28 are at laterally opposing ends to the twelve screen segments 20, which are arranged in two rows of six screen segments each, as shown in FIG. 5. The thus joined segments are then bolted to light supporting structure 10 to form light weight screen cloth 40. It is understood, however, that the four attachment segments 28 and twelve screen segments 20 can also be directly bolted to light supporting structure 10. FIG. 6 is a perspective view of a fully assembled screen cloth as described in FIG. 5 viewed from the top.

As can be seen more clearly in FIG. 3 and FIG. 6, the reason screen cloth 40 is much lighter than the proposed screen cloth in Canadian Patent Application No. 2,992,665, is that for much of the screen cloth's area, the screen cloth is only comprised of two layers, namely, base plate 22 and anti-wear tiles 24, as opposed to three layers, as in Canadian Patent Application No. 2,992,665. In Canadian Patent Application No. 2,992,665, the entirety of the screen cloth is composed of a bottom base plate, a middle support plate and an anti-wear element top layer. The use of the bottom base plate, which is made of steel, adds extra weight, which, when the screen cloths are then attached to a screening device, such as a vibrating screening device, the added weight interferes with the screening device's operation, as, by virtue of the device's design, it goes through ultra high fatigue cycles, which is exponentially sensitive to stresses and, in turn, exponentially sensitive to extra weight.

Interpretation

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

We claim:

1. A screen cloth for use in a screening device for screening out oversize objects, including oil sand lumps and rocks, consisting of:

a support structure consisting of two mutually opposing lateral attachment elements and a plurality of transverse stiffeners, each having a first end and a second end, extending therebetween and attached at their ends to the lateral attachment elements; and a plurality of individually constructed screen segments, each screen segment having a plurality of openings, and each screen segment consisting of a steel base and a plurality of anti-wear tiles attached thereon;

whereby the plurality of screen segments are attached to the support structure to form a screening portion of the screen cloth.

2. The screen cloth of claim 1, wherein the anti-wear tiles are made from a hard metal selected from the group consisting of sintered tungsten carbide, chrome carbide, titanium carbide and ceramic.

3. The screen cloth of claim 1, wherein the anti-wear tiles are made from sintered tungsten carbide comprising between about 89 wt % to about 91 wt % tungsten carbide.

4. The screen cloth of claim 3, wherein the anti-wear tiles are about 6 to 12 mm in thickness.

5. The screen cloth of claim 1, wherein the two mutually opposing lateral attachment elements each have at least one fastening hole for attaching the screen cloth to a screening device.

6. The screen cloth of claim 5, wherein the screening device is a vibrating screening device.

7. The screen cloth of claim 1, wherein the steel base is made of mild steel or stainless steel.

8. The screen cloth of claim 1, wherein the openings of each screen segment are formed by plasma cut or machining.

9. The screen cloth of claim 1, wherein the anti-wear tiles are rectangular or square.

10. The screen cloth of claim 1, wherein the plurality of anti-wear tiles are attached to the plurality of screen segments by means of brazing, mechanical fasteners or industrial adhesive.

11. The screen cloth of claim 1, wherein the plurality of screen segments are first attached to one another prior to being attached to the support structure.

12. The screen cloth of claim 1, wherein the plurality of screen segments are bolted or welded to one another prior to being attached to the support structure.

13. A screen cloth for use in a screening device for screening out oversize objects, including oil sand lumps and rocks, consisting of:

a support structure consisting of two mutually opposing lateral attachment elements and a, plurality of transverse stiffeners, each having a first end and a second end, extending therebetween and attached at their ends to the lateral attachment elements;

a plurality of individually constructed screen segments, each screen segment having at least one opening, and each screen segment consisting of a steel base and at least one anti-wear tile attached thereon; and at least two attachment segments consisting of a steel base and a plurality of anti-wear tiles attached thereon for attaching to the two lateral attachment elements, respectively;

whereby the plurality of screen segments are attached to the support structure to form a screening portion of the screen cloth.

14. The screen cloth of claim 13, wherein the anti-wear tiles are attached to the plurality of screen segments and the at least two attachment segments by means of brazing, mechanical fasteners or industrial adhesive.

15. The screen cloth of claim 13, wherein the plurality of screen segments and the attachment segments are first attached to one another prior to being attached to the support structure.

16. The screen cloth of claim 13, wherein the plurality of screen segments and the attachment segments are bolted or welded to one another prior to being attached to the support structure.

17. The screen cloth of claim 13, whereby there are four attachment segments and twelve screen segments.

18. The screen cloth of claim 13, wherein the anti-wear tiles are made from sintered tungsten carbide comprising between about 89 wt % to about 91 wt % tungsten carbide.

19. The screen cloth of claim 18, wherein the anti-wear tiles are about 6 to 12 mm in thickness.

20. The screen cloth of claim 19, wherein the anti-wear tiles are rectangular or square.

21. The screen cloth of claim 13, wherein the steel base is made of mild steel or stainless steel.

* * * * *